US010575601B2

(12) United States Patent
Esposito et al.

(10) Patent No.: US 10,575,601 B2
(45) Date of Patent: Mar. 3, 2020

(54) STOP FOR ZIPPER ARRANGEMENT

(71) Applicant: Under Armour, Inc., Baltimore, MD (US)

(72) Inventors: Alisa Esposito, Baltimore, MD (US); Merida Miller, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 326 days.

(21) Appl. No.: 15/283,615

(22) Filed: Oct. 3, 2016

(65) Prior Publication Data

US 2017/0095041 A1 Apr. 6, 2017

Related U.S. Application Data

(60) Provisional application No. 62/236,591, filed on Oct. 2, 2015.

(51) Int. Cl.
*A44B 19/36* (2006.01)
*A44B 19/34* (2006.01)
(Continued)

(52) U.S. Cl.
CPC ..... *A44B 19/382* (2013.01); *A41D 27/201* (2013.01)

(58) Field of Classification Search
CPC ..... A44B 19/382; A44B 19/36; A44B 19/403; A44B 19/262; A44B 19/04; A44B 19/34;
(Continued)

(56) References Cited

U.S. PATENT DOCUMENTS 1,990,311 A 2/1935 Salwen
2,146,714 A 2/1939 Austin
(Continued)

FOREIGN PATENT DOCUMENTS

DE 651672 10/1937

OTHER PUBLICATIONS

English language translation of DE651672 (Klenke, published Oct. 16, 1937), 11 pp.
(Continued)

*Primary Examiner* — Robert Sandy
*Assistant Examiner* — Rowland Do
(74) *Attorney, Agent, or Firm* — Maginot, Moore & Beck LLP

(57) ABSTRACT

A garment or accessory includes a fabric portion including an opening and a zipper arrangement to selectively close the opening. The zipper arrangement includes a first toothed portion fixedly coupled to the fabric portion along the at least one opening, and a second toothed portion fixedly coupled to the fabric portion along the opening. The zipper arrangement also includes two sliders. Each slider is slidably received on each of the first toothed portion and the second toothed portion so as to selectively engage the first toothed portion with the second toothed portion and disengage the first toothed portion from the second toothed portion. The zipper arrangement also includes at least one stop formed by the first toothed portion and the second toothed portion such that the first toothed portion is non-releasably engaged with the second toothed portion at the at least one stop.

21 Claims, 14 Drawing Sheets

(51) Int. Cl.

| | |
|---|---|
| ***A44B 19/04*** | (2006.01) |
| ***A44B 19/40*** | (2006.01) |
| ***A44B 19/26*** | (2006.01) |
| ***A44B 19/38*** | (2006.01) |
| ***A41D 27/20*** | (2006.01) |

(58) Field of Classification Search

CPC . A44B 19/265; A41D 27/201; Y10T 24/2561; Y10T 24/2598; Y10T 24/2539; Y10T 24/2541; Y10T 24/2543; Y10T 24/2545; Y10T 24/2552; Y10T 24/2554; Y10T 24/2509; Y10T 24/2513; Y10T 24/2511

See application file for complete search history.

(56) References Cited

U.S. PATENT DOCUMENTS

| | | | | |
|---|---|---|---|---|
| 2,224,930 | A | 12/1940 | Roseman | |
| 2,263,481 | A | 11/1941 | Austin | |
| 2,312,045 | A * | 2/1943 | Morin | A44B 19/36 24/265 A |
| 2,463,937 | A | 3/1949 | Austin | |
| 2,632,933 | A | 3/1953 | Osborne | |
| 2,884,691 | A * | 5/1959 | Rath | A44B 19/36 24/435 |
| 2,889,605 | A | 6/1959 | Morin | |
| 3,004,318 | A | 10/1961 | Morris | |
| 3,510,379 | A * | 5/1970 | Heimberger | A44B 19/60 156/221 |
| 3,605,208 | A | 9/1971 | Carlile | |
| 3,977,051 | A | 8/1976 | Takamatsu | |
| 4,142,275 | A | 3/1979 | Krauer | |
| 4,232,429 | A | 11/1980 | Friedberg | |
| 4,261,082 | A | 4/1981 | Kamiya | |
| 4,309,798 | A | 1/1982 | Fraga | |
| 4,507,805 | A | 4/1985 | Calutoiu | |
| 4,713,946 | A | 12/1987 | Hoerkens | |
| 4,752,992 | A * | 6/1988 | Kondo | A44B 19/36 24/436 |
| 4,819,308 | A | 4/1989 | Baroky | |
| 4,922,585 | A | 5/1990 | Suzuki et al. | |
| 4,997,222 | A | 3/1991 | Reed | |
| 5,020,247 | A | 6/1991 | Barret et al. | |
| 5,079,809 | A | 1/1992 | Teich et al. | |
| 5,081,747 | A | 1/1992 | Takizawa et al. | |
| 5,181,299 | A | 1/1993 | Huang | |
| 5,497,535 | A | 3/1996 | Kloor | |
| 5,697,130 | A | 12/1997 | Smith | |
| 5,836,058 | A | 11/1998 | Cullum | |
| 5,940,941 | A | 8/1999 | Dishner et al. | |
| 5,956,819 | A | 9/1999 | Terasaki et al. | |
| 5,983,465 | A | 11/1999 | Wakai et al. | |
| 6,026,546 | A | 2/2000 | Lund et al. | |
| 6,026,547 | A | 2/2000 | O'Donnell Kiely | |
| 6,088,888 | A | 7/2000 | Oda | |
| 6,119,270 | A | 9/2000 | Chou | |
| 6,182,338 | B1 | 2/2001 | Watanabe | |
| 6,243,926 | B1 | 6/2001 | Takashima et al. | |
| 6,279,209 | B1 | 8/2001 | Kang | |
| 6,430,785 | B1 | 8/2002 | Matsushima et al. | |
| 6,453,521 | B1 | 9/2002 | Dischler | |
| 6,490,770 | B1 | 12/2002 | Matsuda et al. | |
| 6,499,200 | B1 | 12/2002 | Yamagishi et al. | |
| 6,502,285 | B2 | 1/2003 | Kiely | |
| 6,536,084 | B2 | 3/2003 | Davis | |
| 6,571,432 | B1 | 6/2003 | Rindle | |
| 6,588,072 | B1 | 7/2003 | Lin | |
| 6,604,263 | B1 | 8/2003 | Dischler | |
| 6,681,456 | B1 | 1/2004 | Dischler | |
| 6,701,584 | B2 | 3/2004 | Metzger | |
| 6,832,415 | B2 | 12/2004 | Higginbotham | |
| 6,851,162 | B2 | 2/2005 | Yuki et al. | |
| 6,976,293 | B2 | 12/2005 | Traulle et al. | |
| 7,017,242 | B2 | 3/2006 | Bemasconi | |
| 7,036,190 | B2 | 5/2006 | Demarest | |
| 7,036,192 | B2 | 5/2006 | Yoneoka | |
| 7,043,802 | B2 | 5/2006 | Moeller et al. | |
| 7,111,714 | B1 | 9/2006 | Bell, III | |
| 7,114,224 | B2 | 10/2006 | Kondo et al. | |
| 7,137,177 | B2 | 11/2006 | Fujii et al. | |
| 7,152,438 | B2 | 12/2006 | Matsuda | |
| 7,188,395 | B2 | 3/2007 | Kondo et al. | |
| 7,200,900 | B2 | 4/2007 | Berns | |
| 7,204,001 | B2 | 4/2007 | Lin | |
| 7,293,334 | B2 | 11/2007 | Metzger | |
| 7,313,847 | B1 | 1/2008 | Felix et al. | |
| 7,353,570 | B2 | 4/2008 | Himi | |
| 7,404,240 | B2 | 7/2008 | Nedbal et al. | |
| 7,621,025 | B2 | 11/2009 | Sanna | |
| 7,665,194 | B2 | 2/2010 | Iwase | |
| 2001/0004787 | A1 | 6/2001 | Nagata et al. | |
| 2003/0056342 | A1 | 3/2003 | Iwase et al. | |
| 2003/0177616 | A1 | 9/2003 | Petravic et al. | |
| 2004/0020017 | A1 | 2/2004 | Nedbal et al. | |
| 2004/0074059 | A1 | 4/2004 | Traulle et al. | |
| 2004/0088834 | A1 | 5/2004 | Yu | |
| 2004/0117954 | A1 | 6/2004 | Lin | |
| 2004/0148745 | A1 | 8/2004 | Moeller et al. | |
| 2005/0102803 | A1 | 5/2005 | Wen et al. | |
| 2005/0166371 | A1 | 8/2005 | Tseng et al. | |
| 2005/0204516 | A1 | 9/2005 | Leva et al. | |
| 2005/0204517 | A1 | 9/2005 | Demarest | |
| 2005/0268438 | A1 | 12/2005 | Chung | |
| 2006/0112523 | A1 | 6/2006 | Deto et al. | |
| 2006/0218758 | A1 | 10/2006 | Chang | |
| 2006/0242804 | A1 | 11/2006 | Griffiths | |
| 2007/0107171 | A1 | 5/2007 | Kojima | |
| 2007/0135953 | A1 | 6/2007 | Crow | |
| 2007/0289110 | A1 | 12/2007 | Bekeschus | |
| 2008/0115337 | A1 * | 5/2008 | Ohgaku | A44B 19/36 24/433 |
| 2008/0155797 | A1 | 7/2008 | Tamura | |
| 2008/0209695 | A1 | 9/2008 | Matsui et al. | |
| 2008/0222854 | A1 | 9/2008 | Keyaki et al. | |
| 2009/0013505 | A1 | 1/2009 | Hasegawa et al. | |
| 2009/0049659 | A1 | 2/2009 | Takani et al. | |
| 2009/0056086 | A1 | 3/2009 | Ujihara et al. | |
| 2009/0077774 | A1 | 3/2009 | Lee et al. | |
| 2009/0094805 | A1 | 4/2009 | Keyaki et al. | |
| 2009/0049658 | A1 | 8/2009 | Takasawa et al. | |
| 2009/0229090 | A1 | 9/2009 | Cossutti et al. | |
| 2009/0320250 | A1 | 12/2009 | Yamamoto et al. | |
| 2010/0005557 | A1 | 1/2010 | Cossutti et al. | |
| 2010/0313387 | A1 | 12/2010 | Peters et al. | |
| 2011/0232048 | A1 * | 9/2011 | Mima | B60N 2/5825 24/401 |
| 2011/0296654 | A1 | 12/2011 | Sato | |
| 2012/0042433 | A1 * | 2/2012 | Damon | A44B 19/38 2/69 |
| 2012/0117728 | A1 * | 5/2012 | O'Neill | A47C 31/007 5/499 |
| 2012/0159746 | A1 | 6/2012 | Matsumoto | |
| 2012/0174283 | A1 | 7/2012 | Peters et al. | |
| 2012/0260468 | A1 | 10/2012 | Nozaki et al. | |
| 2013/0117935 | A1 * | 5/2013 | Rensink | A47C 31/007 5/499 |

OTHER PUBLICATIONS

European Search Report from the EU Application No. 11818597.4, dated Feb 18, 2014.

* cited by examiner

STOP FOR ZIPPER ARRANGEMENT

CROSS-REFERENCE TO RELATED APPLICATIONS

This patent document claims priority to U.S. provisional patent application No. 62/236,591, filed Oct. 2, 2015, the entire contents of which are incorporated herein by reference.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD

This application relates to the field of fastening devices, and particularly to zipper arrangements.

BACKGROUND

Zippers are commonly used to fasten opposing fabric portions. One typical use for zippers is to close two separate fabric portions which form a pocket in a garment or accessory. An advantage of using a zipper to close a pocket is that when the zipper is closed, items stored in the pocket are less likely to be inadvertently removed from the pocket.

One disadvantage of using a zipper to close a pocket is that the zipper adds bulk to the garment or accessory. Each zipper includes two sets of interlocking teeth attached to a trim or flashing material. The flashing material is sewn to the garment or accessory, adding another layer of material to the garment or accessory. Added bulk may be undesirable in garments which the user wishes to conform closely to the body for improved aerodynamics and aesthetics. Additionally, added bulk may be undesirable in garments because it may increase the risk of chafing where the added bulk rubs against the body of the user during wear. Added bulk may also be undesirable in accessories for the same reasons.

Another disadvantage of using a zipper to close a pocket is that the zipper adds material and labor costs to the production of the garment or accessory. Each added zipper must be sewn precisely into the garment or accessory to function properly, which complicates construction of the garment or accessory. Accordingly, each added zipper proportionately increases material and labor costs to the garment or accessory.

In view of the foregoing, it would be advantageous to provide a zipper arrangement which provides the advantages of closing a pocket and also minimizes the bulk added to the garment or accessory and minimizes the additional labor and material costs of the garment or accessory.

SUMMARY

A garment or accessory including a single zipper arrangement which provides access to multiple pockets is disclosed herein. The garment or accessory includes at least one fabric portion including at least one opening and a zipper arrangement. The zipper arrangement includes a first toothed portion and a second toothed portion, each of which is fixedly coupled to the at least one fabric portion along the at least one opening. The zipper arrangement also includes at least one stop formed by the first toothed portion and the second toothed portion such that the first toothed portion is non-releasably or irremovably engaged with the second toothed portion at the at least one stop.

In at least one embodiment, the at least one opening includes a first opening edge and a second opening edge. The first toothed portion is fixedly coupled to the at least one fabric portion along the first opening edge, and the second toothed portion is fixedly coupled to the at least one fabric portion along the second opening edge.

In at least one embodiment, the at least one opening forms a first sub-opening on a first side of the at least one stop and a second sub-opening on a second side of the at least one stop. The first toothed portion and the second toothed portion form the first sub-opening, and the first toothed portion and the second toothed portion form the second sub-opening. A first pocket is accessible through the first sub-opening, and a second pocket is accessible through the second sub-opening.

In at least one embodiment, the zipper arrangement also includes at least two sliders, each of which is slidably received on each of the first toothed portion and the second toothed portion so as to selectively engage the first toothed portion with the second toothed portion and disengage the first toothed portion from the second toothed portion. The at least two sliders include a first slider slidably retained on the first and second toothed portions at the first sub-opening and a second slider slidably retained on the first and second toothed portions at the second sub-opening.

A zipper arrangement is also disclosed herein. The zipper arrangement includes a first toothed portion, a second toothed portion, and at least one stop formed by the first toothed portion and the second toothed portion such that the first toothed portion is non-releasably engaged with the second toothed portion at the at least one stop. The zipper arrangement further includes a first slider configured to be slidably received on the first toothed portion and the second toothed portion on a first side of the at least one stop to selectively engage the first toothed portion with the second toothed portion and disengage the first toothed portion from the second toothed portion on the first side of the at least one stop. The zipper arrangement also includes a second slider configured to be slidably received on the first toothed portion and the second toothed portion on a second side of the at least one stop to selectively engage the first toothed portion with the second toothed portion and disengage the first toothed portion from the second toothed portion on the second side of the at least one stop.

The above described features and advantages, as well as others, will become more readily apparent to those of ordinary skill in the art by reference to the following detailed description and accompanying drawings. While it would be desirable to provide a zipper arrangement that provides one or more of these or other advantageous features, the teachings disclosed herein extend to those embodiments which fall within the scope of the appended claims, regardless of whether they accomplish one or more of the above-mentioned features or advantages.

All Figures© Under Armour, Inc. 2016. All rights reserved.

DETAILED DESCRIPTION

Figure 1A:
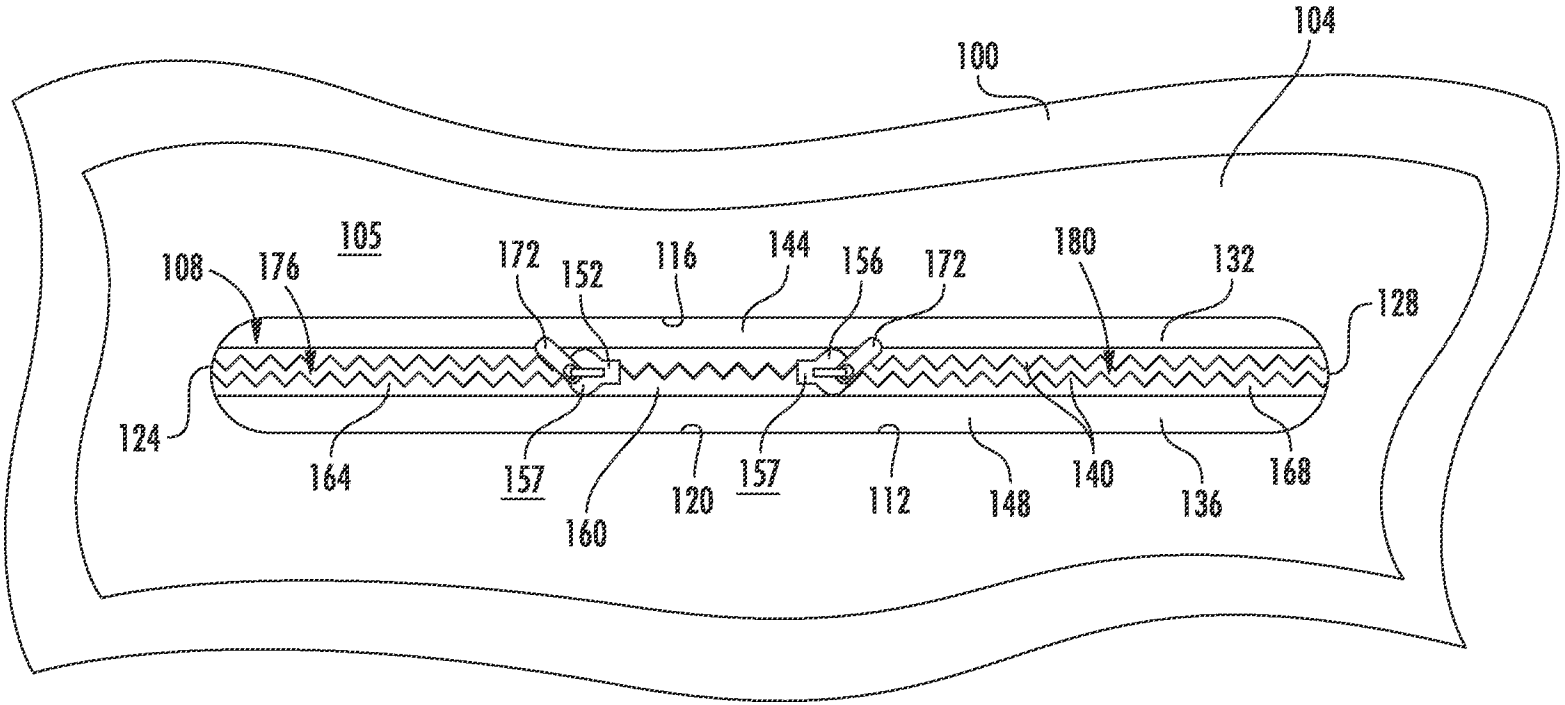
FIG. 1A shows a front side of a fabric portion of a garment or accessory including a zipper arrangement which is open.
Figure 1B:
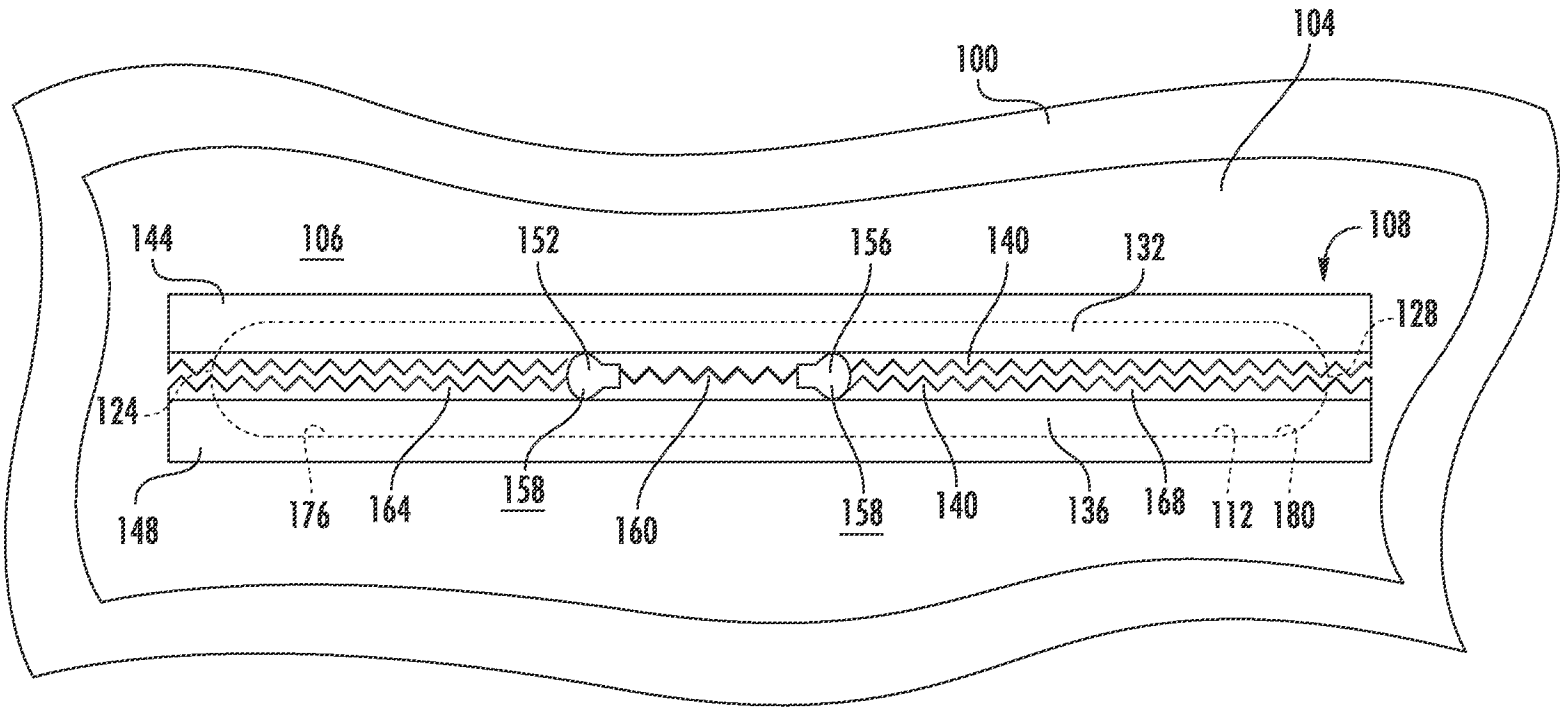
FIG. 1B shows a back side of the fabric portion of the garment or accessory including the zipper arrangement which is open.

As shown in FIGS. 1A and 1B, a garment or accessory 100, for example, a jacket, pants, a belt, a bag, or any other article of apparel, includes a fabric portion 104 having a front side 105 (shown in FIG. 1A) and a back side 106 (shown in FIG. 1B). The fabric portion 104 can be located anywhere on the garment or accessory 100 where it is desirable or advantageous to have a pocket. For example, the fabric portion 104 can be located on an arm portion or a torso portion of a jacket, or on an interior or an exterior of a bag. The garment or accessory 100 further includes an opening 112, which is formed through the front side 105 and the back side 106 of the fabric portion 104, and a zipper arrangement 108, which is fixedly coupled to the back side 106 of the fabric portion 104. As described in more detail below, the zipper arrangement 108 is fixedly coupled to the back side 106 of the fabric portion 104 adjacent to the opening 112 so as to enable selectively opening and closing the opening 112 from the front side 105 of the fabric portion 104.

The opening 112 is generally formed as a slit such that the opening 112 defines a first opening edge 116 and a second opening edge 120. In the embodiment shown, the slit is a substantially straight line or narrow rectangular shape. In alternative embodiments, however, the opening 112 can be formed in other shapes, such as, for example, a curve or an arc. Regardless of the shape of the opening 112, the first opening edge 116 is arranged approximately opposite and parallel to the second opening edge 120 such that the first opening edge 116 and the second opening edge 120 meet at first opening end 124 and second opening end 128.

The zipper arrangement 108 includes a first toothed portion 132 and a second toothed portion 136. As shown in FIG. 1B, the zipper arrangement 108 is affixed to the back side 106 of the fabric portion 104 so as to cover the entire opening 112 (shown in dashed lines in FIG. 1B). In other words, the zipper arrangement 108 is affixed to the fabric portion 104 such that the first toothed portion 132 extends along the entirety of the first opening edge 116 and beyond the first opening end 124 and the second opening end 128. Similarly, the second toothed portion 136 extends along the entirety of the second opening edge 120 and beyond the first opening end 124 and the second opening end 128.

The first toothed portion 132 is configured to engage with and disengage from the second toothed portion 136 via interlocking teeth 140 in a manner that is generally known. In one embodiment, the interlocking teeth 140 can be made of a hardened plastic material. In another embodiment, the interlocking teeth 140 can be made of a metal material. The interlocking teeth 140 of the first toothed portion 132 are arranged on a first flashing 144, and the interlocking teeth 140 of the second toothed portion 136 are arranged on a second flashing 148. Each of the first and second flashings 144, 148 are made of a fabric material, which is affixed to the back side 106 of the fabric portion 104 adjacent to the opening 112 such that the interlocking teeth 140 are positioned extending across the opening 112.

Figure 10A:
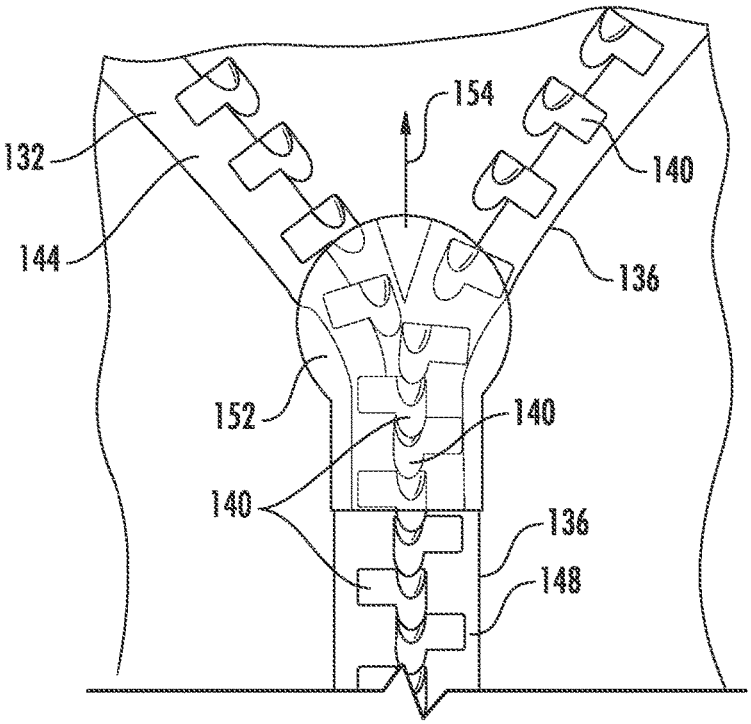
FIG. 10A shows a first exemplary embodiment of interlocking teeth configured for use with the zipper arrangement of FIG. 1A.
Figure 10B:
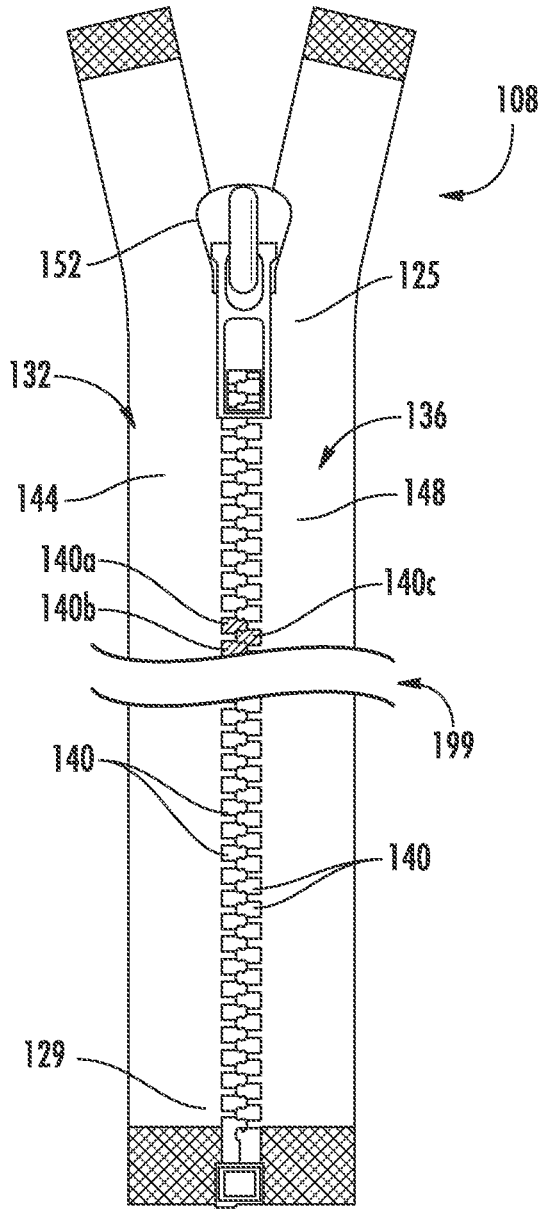
FIG. 10B shows another exemplary embodiment of a zipper arrangement of FIG. 1A, including a second exemplary embodiment of interlocking teeth for use with the zipper arrangement.

While the interlocking teeth 140 are represented in FIGS. 1A-3A by the jagged edges along the first and second flashings 144, 148, it will be recognized that these jagged edges are merely for illustration purposes in the drawings. The actual teeth 140 in the zipper arrangement 108 are configured with features that facilitate interlocking of the teeth. FIG. 10A shows a version of one embodiment of the teeth 140 with interlocking features such that the teeth 140 of the first toothed portion 132 interlock with the teeth 140 of the second toothed portion 136. As shown in FIG. 10A, the teeth 140 are evenly and continuously spaced along the first toothed portion 132 and the second toothed portion 136. Movement of a slider 152 in a first direction (noted by arrow 154 in FIG. 10A) causes the teeth to interlock and couple the first toothed portion 132 to the second toothed portion 136. Movement of the slider 152 in the opposite direction causes the teeth to release from one another and decouples the first toothed portion 132 from the second toothed portion 136. Similar to FIG. 10A, FIG. 10B shows another embodiment of the teeth 140 with interlocking features such that the teeth 140 of the first toothed portion 132 interlock with the teeth 140 of the second toothed portion 136. As shown in FIG. 10B, the teeth 140 are evenly and continuously spaced between a first end 125 and the second end 129 of the zipper arrangement 108.

Figure 2:
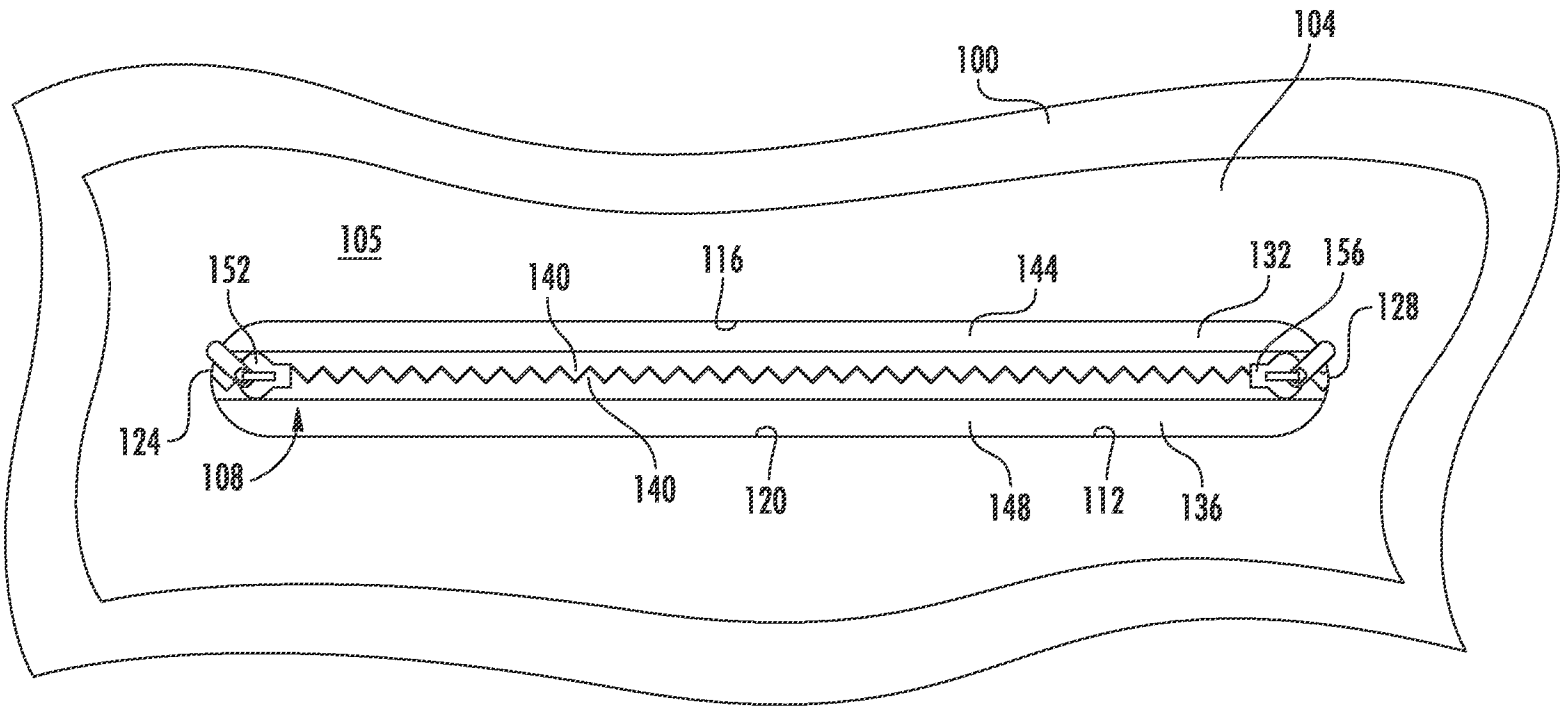
FIG. 2 shows a front side of the fabric portion of the garment or accessory of FIGS. 1A and 1B including the zipper arrangement which is closed.

With reference again to FIGS. 1A-3A, the zipper arrangement 108 further includes both a first slider 152 and a second slider 156, each of which is slidably received on both of the first toothed portion 132 and the second toothed portion 136 and configured to engage and disengage the interlocking teeth 140 to close and open the opening 112. As shown in FIGS. 1A and 1B, where the interlocking teeth 140 of the first toothed portion 132 are disengaged from the interlocking teeth 140 of the second toothed portion 136, the opening 112 is open. Conversely, as shown in FIG. 2, where the interlocking teeth 140 of the first toothed portion 132 are engaged with the interlocking teeth 140 of the second toothed portion 136, the opening 112 is closed.

As shown in FIG. 1A, each of the first and second sliders 152, 156 has an outwardly facing side 157, which is accessible from the front side 105 of the fabric portion 104 when the zipper arrangement 108 is affixed to the back side 106 of the fabric portion 104. Each of the first and second sliders 152, 156 is provided with a tab 172, which is engaged with the outwardly facing side 157 of the respective slider 152, 156. The tabs 172 are arranged and configured to enable gripping and pulling the sliders 152, 156 along the first and second toothed portions 132, 136 to open and close the opening 112. As shown in FIG. 1B, each of the first and second sliders 152, 156 also has an inwardly facing side 158, which is accessible from the back side 106 of the fabric portion 104 when the zipper arrangement is affixed to the back side 106 of the fabric portion 104.

The zipper arrangement 108 further includes a stop 160, which is formed by a portion of the interlocking teeth 140 of the first toothed portion 132 and the second toothed portion 136 that are irremovably engaged. In other words, the interlocking teeth 140 of the first and second toothed portions 132, 136 are permanently engaged at the stop 160 such that removal of the first toothed portion 132 from the second toothed portion 136 will result in at least partial destruction of the stop 160. The stop 160 prevents the first and second sliders 152, 156 from sliding on the first and second toothed portions 132, 136 where the interlocking teeth 140 are non-releasable and therefore permanently engaged. Accordingly, the first slider 152 is retained on a first side 164 of the stop 160, between the first opening end 124 and the stop 160, and the second slider 156 is retained on a second side 168 of the stop 160, between the second opening end 128 and the stop 160. Accordingly, the first opening end 124 and the second opening end 128 may also be considered end stops, as they provide end boundaries for the first and second sliders 152, 156 on the zipper arrangement, and the teeth terminate in the vicinity of the end stops. The stop 160 may be considered a central stop because the teeth 140 extend through the stop and along opposite sides of the stop 160 with the first and second sliders 152, 156 configured to move along both sides of the stop 160.

The stop 160 forms a first sub-opening 176 and a second sub-opening 180 of the single opening 112. Each of the first and second sub-openings 176, 180 is delimited by the first opening edge 116 and the second opening edge 120 of the opening 112. The first sub-opening 176 is also delimited by the first opening end 124 of the opening 112 and the stop 160, and the second sub-opening 180 is also delimited by the second opening end 128 of the opening 112 and the stop 160. Because the first and second toothed portions 132, 136 of the zipper arrangement 108 extend along the entire first and second opening edges 116, 120, both of the first and second toothed portions 132, 136 extend along each of the first and second sub-openings 176, 180. Accordingly, the first slider 152 slides along the first and second toothed portions 132, 136 between the first opening end 124 and the stop 160 to open and close the first sub-opening 176. Similarly, the second slider 156 slides along the first and second toothed portions 132, 136 between the stop 160 and the second opening end 128 to open and close the second sub-opening 180.

In one embodiment, the stop 160 can be formed by applying a plastic piece configured to engage interlocking teeth 140 so as to irremovably or non-releasably engage the interlocking teeth 140. For example, the stop 160 can be formed by affixing a pin or a clip (not shown) in between or onto the interlocking teeth 140. In an alternative embodiment, the stop 160 can be formed by melting (e.g. welding or otherwise fusing) engaged interlocking teeth 140 together so as to irremovably or non-releasably engage the interlocking teeth 140. In other alternative embodiments, the stop 160 can be formed by applying an adhesive to engaged interlocking teeth 140, by sewing engaged interlocking teeth 140 to the fabric material 104, or by another method which irremovably or non-releasably engages the interlocking teeth 140. For example, the stop 160 may comprise a piece of tape, such as a seam tape or other adhesive strip extending across the stop on the back side 106 of the fabric portion 104, or may comprise a glue or cured resin material that irremovably or non-releasably joins the interlocking teeth 140 of the first toothed portion 132 to the interlocking teeth 140 of the second toothed portion 136 at the stop 160. In other words, the stop 160 can include any mechanical element or feature which engages and locks the interlocking teeth 140 of the first toothed portion 132 to the interlocking teeth 140 of the second toothed portion 136.

Figure 3A:
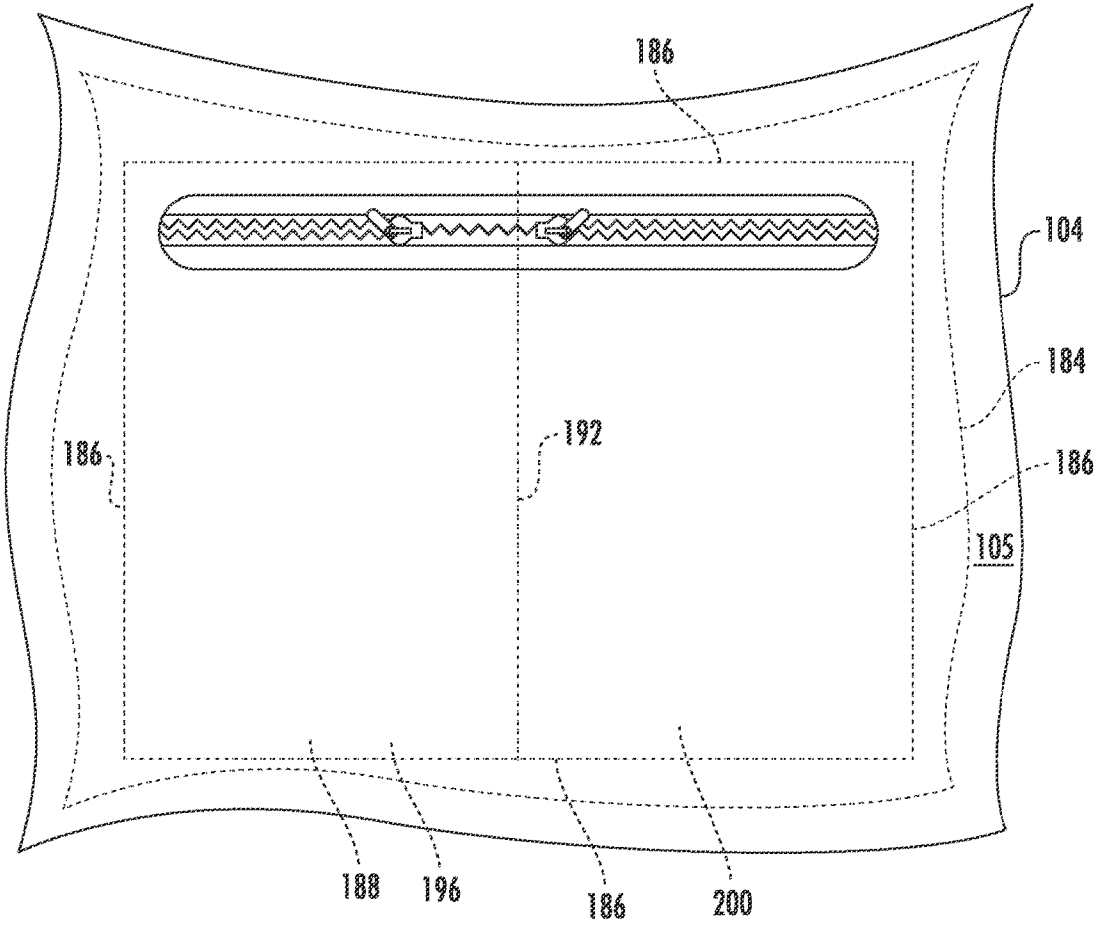
FIG. 3A shows a front side of the fabric portion of FIGS. 1A and 1B with a backing affixed to the fabric portion.
Figure 3B:
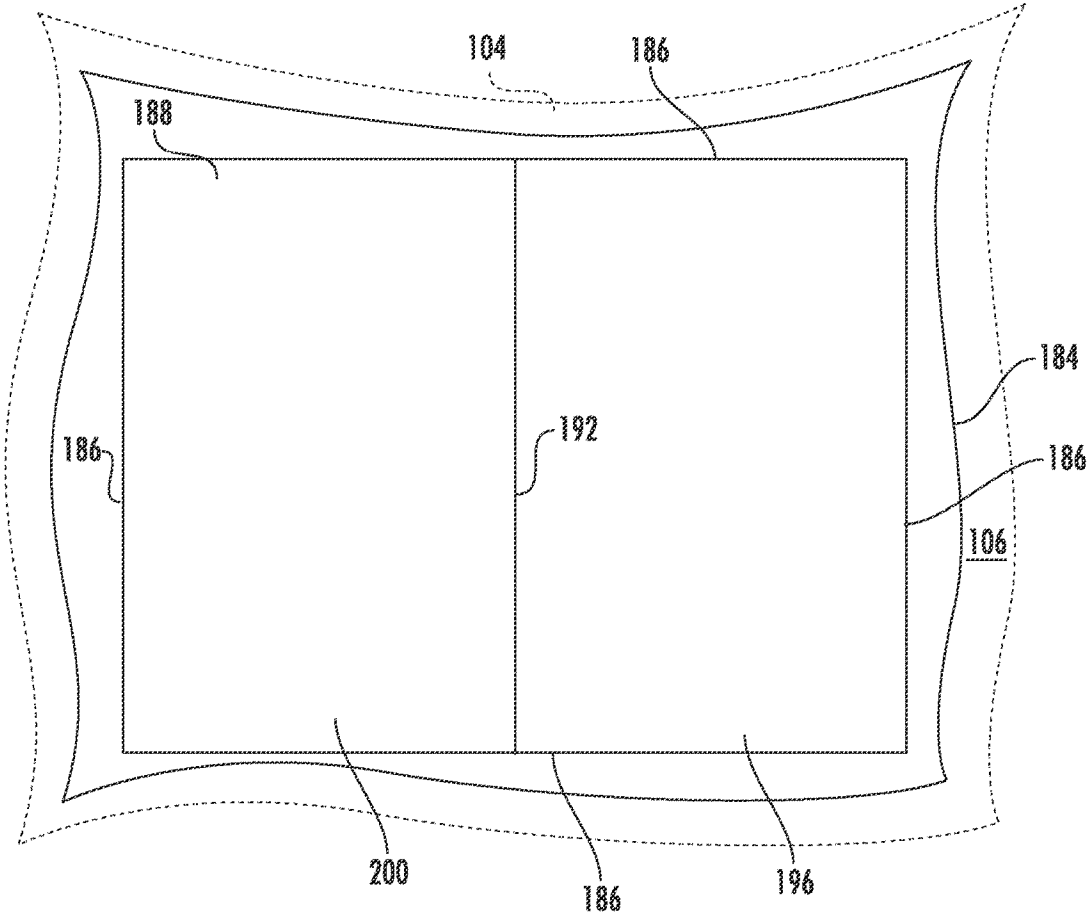
FIG. 3B shows a back side of the fabric portion of FIGS. 1A and 1B with the backing affixed to the fabric portion.

As shown in FIGS. 3A and 3B, the garment or accessory 100 further includes a backing 184, which is also affixed to the back side 106 of the fabric portion 104. In FIG. 3A, the front side 105 of the fabric portion 104 is shown, and the backing 184 is shown with dashed lines. In FIG. 3B, the back side 106 of the fabric portion 104 is shown, and the fabric portion 104 is shown with dashed lines. The backing 184 is affixed to the fabric portion 104 along seams 186 which form a complete perimeter such that the seams 186 form a pocket 188 between the backing 184 and the fabric portion 104. The backing 184 is made of a material which can be affixed to the back side 106 of the fabric portion 104 by bonding, sewing, or another method of firmly affixing a material to a fabric material at the seams 186. In other words, the seams 186 are formed by bonding, sewing, or otherwise firmly affixing the backing 184 to the back side 106 of the fabric portion 104.

The backing 184 is also affixed to the back side 106 of the fabric portion 104 at a pocket separation 192. Like the seams 186, the pocket separation 192 can be formed by bonding, sewing, or otherwise firmly affixing the backing 184 to the back side 106 of the fabric portion 104. The pocket separation 192 extends across the perimeter formed by the seams 186 to separate the pocket 188 into a first sub-pocket 196 and a second sub-pocket 200. In the embodiment shown, the seams 186 form a rectangular perimeter of the pocket 188, and the pocket separation 192 extends approximately through the middle of the rectangular perimeter to form first and second sub-pockets 196, 200 which are approximately equally sized and congruently shaped. In alternative embodiments, however, the seams 186 can form a non-rectangular perimeter of the pocket 188. Additionally, in alternative embodiments, the pocket separation 192 can be positioned so as to form first and second sub-pockets 196, 200 which are not equally sized and are not congruently shaped. In other words, the pocket separation 192 can be positioned so as to divide the pocket 188 into sub-pockets 196, 200 having different sizes and shapes.

In the embodiment shown, the backing 184 is affixed to the back side 106 of the fabric portion 104 at one pocket separation 192 to form two sub-pockets 196, 200. In alternative embodiments, however, the backing 184 can be affixed to the fabric portion 104 at more than one pocket separation 192. In other words, multiple pocket separations 192 can extend across the perimeter formed by the seams 186 of the pocket 188 to form more than two sub-pockets. Any number of sub-pockets can be formed by including a number of pocket separations that is one fewer than the desired number of sub-pockets. As in embodiments with a single pocket separation 192, in embodiments having more than one pocket separation 192, the pocket separations can be formed at any position across the perimeter formed by the seams 186. Furthermore, the pocket separations can be spaced apart at regular or irregular intervals across the perimeter and can form congruent or incongruent sub-pockets.

As shown in FIGS. 3A and 3B, the backing 184 is affixed to the back side 106 of the fabric portion 104 such that the opening 112 and the zipper arrangement 108 are arranged near a seam 186 of the pocket 188. Positioning the zipper arrangement 108 near a top seam 186 helps prevent items received within the pocket 188 from falling out of the pocket 188 due to gravity. Additionally, the backing 184 and the zipper arrangement 108 are positioned on the fabric portion 104 such that the stop 160 of the zipper arrangement 108 is aligned with the pocket separation 192 of the backing 184. Accordingly, the first sub-opening 176 of the opening 112 is aligned with the first sub-pocket 196 and the second sub-opening 180 is aligned with the second sub-pocket 200. Thus, the first slider 152 selectively provides access to the first sub-pocket 196 from the front side 105 of the fabric portion 104 by opening and closing the first sub-opening 176. Similarly, the second slider 156 selectively provides access to the second sub-pocket 200 from the front side 105 of the fabric portion 104 by opening and closing the second sub-opening 180.

In the embodiment shown, the stop 160 is formed at a generally centered location between the first opening end 124 and the second opening end 128 so as to align with the generally centered pocket separation 192 when the zipper arrangement 108 and the backing 184 are affixed to the back side 106 of the fabric portion 104. In alternative embodiments, however, wherein the pocket separation 192 is not centered within the pocket 188, the stop 160 is formed at a different position between the first and second opening ends 124, 128 so as to align with the pocket separation 192.

In other words, the stop 160 and the pocket separation 192 are positioned so as to be aligned with one another such that the first and second sub-openings 176, 180 are aligned with the first and second sub-pockets 196, 200. The first sub-opening 176 corresponds to and provides access to the first sub-pocket 196, and the second sub-opening 180 corresponds to and provides access to the second sub-pocket 200. In at least one embodiment, the stop 160 and pocket separation 192 are arranged such that the first sub-opening 176 and first sub-pocket 196 are smaller than the second sub-opening 180 and second sub-pocket 200. Conversely, in at least one other embodiment, the stop 160 and pocket separation 192 are arranged such that the first sub-opening 176 and first sub-pocket 196 are larger than the second sub-opening 180 and second sub-pocket 200. In at least one embodiment, the first sub-opening 176 may have a length of approximately 1-5 inches, such as 3 inches for example. This arrangement would allow the first sub-pocket 196 to receive a smaller item (e.g. a small personal electronics device such as a key, a mobile telephone, a wallet, cosmetics, etc.). In at least one embodiment, the second sub-opening may have a length of approximately 5-9 inches, such as six inches for example. This arrangement would allow the second sub-pocket 200 to receive a larger item (e.g. the user's hand, a larger electronics device, etc.). In at least one embodiment, the lengths of the first and second sub-openings 176, 180, and thus the sizes of the first and second sub-pockets 196, 200 can be reversed. Again, while one or more embodiments of the stop 160, first and second sub-openings 176, 180, and first and second sub-pockets 196, 200 of the zipper arrangement 108 have been disclosed herein, it will be recognized that various additional arrangements are also contemplated.

In the embodiment shown, the zipper arrangement 108 includes one stop 160 (i.e., the central stop) which forms first and second sub-openings 176, 180 from the single opening 112 (the single opening 112 formed between the first and second opening ends 124, 128). In alternative embodiments, however, the zipper arrangement 108 can include more than one stop 160 to form more than two sub-openings to align with more than two sub-pockets formed by more than one pocket separation 192. In the same way that any number of sub-pockets can be formed by including a number of pocket separations 192 that is one fewer than the desired number of sub-pockets, the zipper arrangement 108 can form any number of sub-openings by including a number of stops 160 that is one fewer than the desired number of sub-openings. The number of sub-openings can be the same as the number of sub-pockets so that each sub-opening corresponds to a single sub-pocket. Alternatively, however, the garment or accessory 100 can include more sub-openings than sub-pockets such that more than one sub-opening can provide access to the same sub-pocket. In some embodiments, a single slider 152, 156 is provided in association with each sub-opening. For example, if the zipper arrangement includes two stops However, in one embodiment, multiple sliders 152, 156 may be provided in association with each sub-opening.

In the embodiment shown, the first and second sliders 152, 156 are arranged to mirror one another relative to the stop 160. The first and second sliders 152, 156 are both moved toward the stop 160 to open the respective first and second sub-pockets 196, 200 and away from the stop 160 to close the respective first and second sub-pockets 196, 200. In an alternative embodiment, the first and second sliders 152, 156 can be reversed such that moving the sliders 152, 156 toward the stop 160 closes the sub-pockets 196, 200 and moving the sliders 152, 156 away from the stop 160 opens the sub-pockets 196, 200.

Additionally, in further alternative embodiments, the first and second sliders 152, 156 can be arranged in the same direction such that moving the sliders 152, 156 away from the first opening end 124 opens the sub-pockets 196, 200 and moving the sliders 152, 156 toward the first opening end 124 closes the sub-pockets 196, 200. Conversely, the first and second sliders 152, 156 can be arranged such that moving the sliders 152, 156 away from the first opening end 124 closes the sub-pockets 196, 200 and moving the sliders toward the first opening end 124 opens the sub-pockets 196, 200.

In the embodiment shown, only one fabric portion 104 and one backing 184 are included on the garment or accessory 100. In alternative embodiments, however, the garment or accessory 100 can include more than one fabric portion 104 and corresponding backing 184. Each fabric portion 104 can include one opening 112 and corresponding zipper arrangement 108, as described above. In further alternative embodiments, however, each fabric portion 104 can include more than one opening 112 and corresponding zipper arrangement 108.

One advantage of the zipper arrangement 108 is that a single zipper can be used to close more than one pocket. Thus, the zipper arrangement 108 can reduce bulk added to the garment or accessory 100, because only one zipper must be added to the garment or accessory to close multiple pockets. Additionally, the zipper arrangement 108 can reduce added material and labor costs during production of the garment or accessory 100, because only one zipper must be added to the garment or accessory to close multiple pockets.

Figure 4:
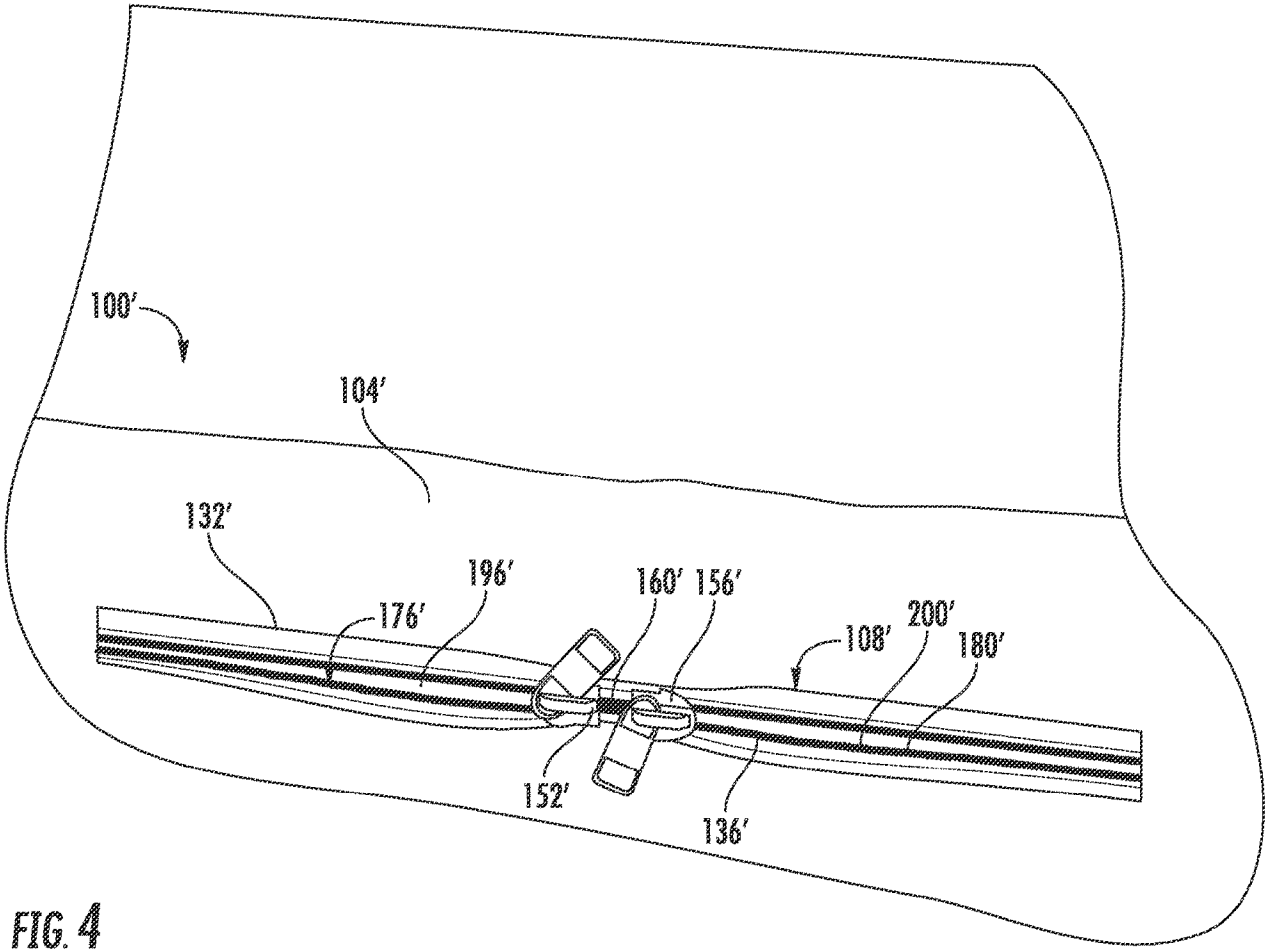
FIG. 4 shows another embodiment of a front side of a fabric portion of a garment or accessory including a zipper arrangement which is open.
Figure 5:
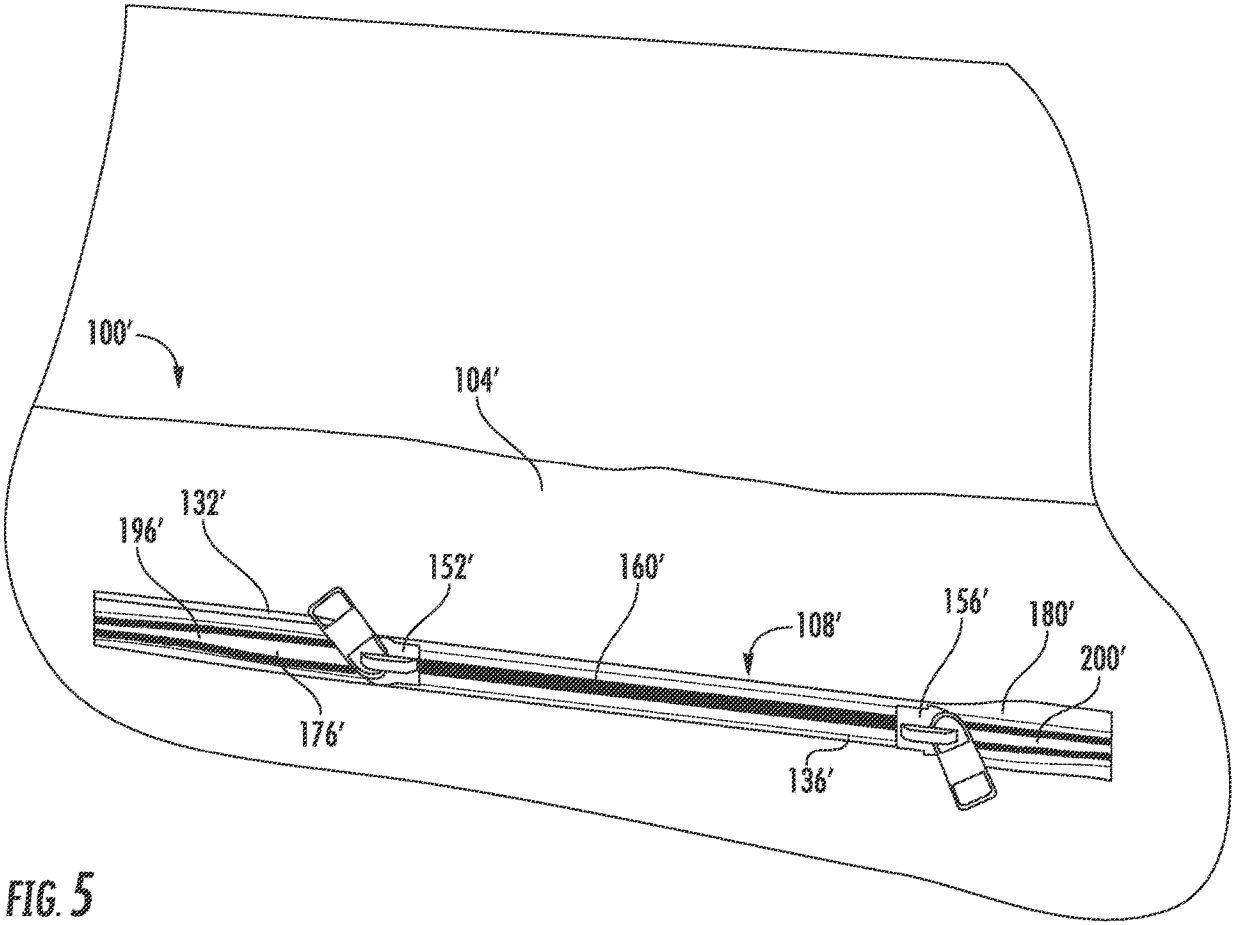
FIG. 5 shows the front side of the fabric portion of the garment or accessory of FIG. 4 including the zipper arrangement which is partially closed.
Figure 6:
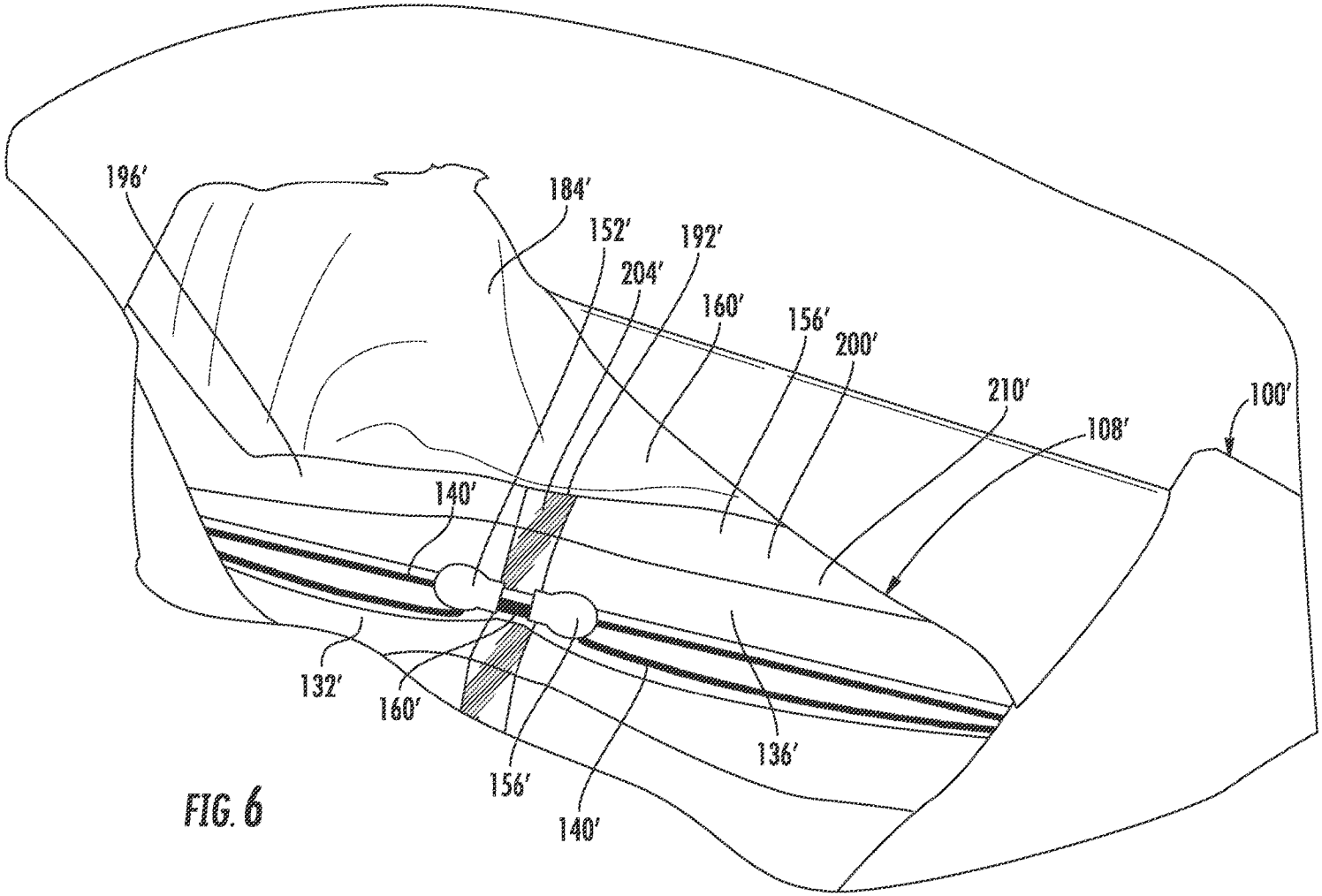
FIG. 6 shows a back side of the fabric portion of the garment or accessory of FIG. 4 including the zipper arrangement which is open.

Turning now to FIGS. 4, 5, and 6, one embodiment of a garment or accessory 100' is shown. The garment or accessory 100' is substantially similar to the garment or accessory 100 shown and described above. Accordingly, features of the garment or accessory 100' which are described above with reference to garment or accessory 100 are not described again, and similar reference numerals are used to refer to similar features. The garment or accessory 100' includes a fabric portion 104' and a zipper arrangement 108'. In this embodiment, at least one of the fabric portion 104' and the zipper arrangement 108' can be waterproof to protect contents within the pocket 188', including sub-pockets 196', 200', from external moisture.

As shown in FIGS. 4 and 5, the first and second toothed portions 132', 136' are affixed to the back side 106' (shown in FIG. 6) of the fabric portion 104' such that the zipper arrangement 108' lies substantially flush with the fabric portion 104'. As shown in FIG. 5, when the first and second sliders 152', 156' are moved away from the stop 160' so that the sub-pockets 196', 200' are partially closed, the stop 160' between the first sub-opening 176' and the second sub-opening 180' is barely noticeable.

In FIG. 6, the garment or accessory 100' is shown with a portion of the backing 184' separated from the back side 106' of the fabric portion 104' so that the zipper arrangement 108' within the pocket 188' is visible on the back side 106' of the fabric portion 104'. In this embodiment, the stop 160' is at least partially formed by applying a tape strip 204' to the engaged interlocking teeth 140' of the first and second toothed portions 132', 136' to prevent the first and second sliders 152', 156' from moving past the stop 160'. Although the backing 184' is partially separated from the back side 106' of the fabric portion 104', the pocket separation 192' aligned with the stop 160' is partially visible in FIG. 6.

Turning now to FIGS. 7A, 7B, 8, and 9, another embodiment of a zipper arrangement 108" is shown. In the figures, the zipper arrangement 108" is not attached to a fabric portion of a garment or accessory. However, the zipper arrangement 108" can be used in substantially the same way as the zipper arrangements 108, 108' shown and described above. Accordingly, features of the zipper arrangement 108" which are described above with reference to zipper arrangements 108, 108' are not described again, and similar reference numerals are used to refer to similar features.

Figure 7A:
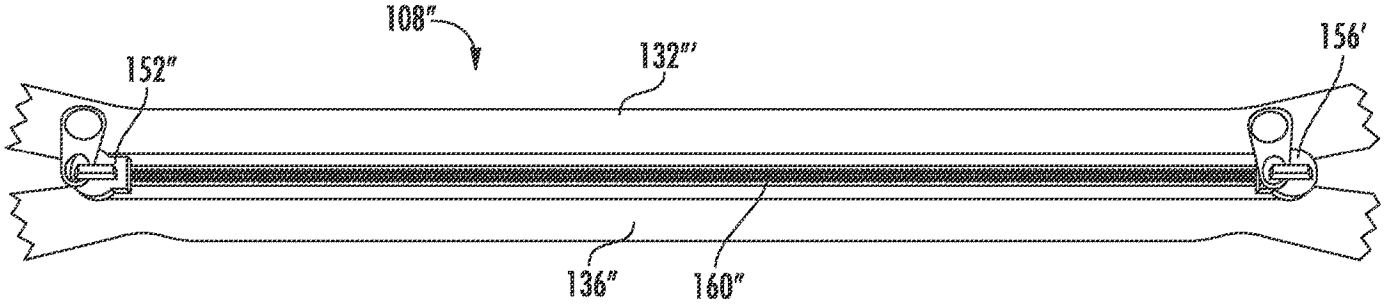
FIG. 7A shows another embodiment of a front side of a zipper arrangement, which is closed, and which is not attached to a fabric portion.
Figure 7B:
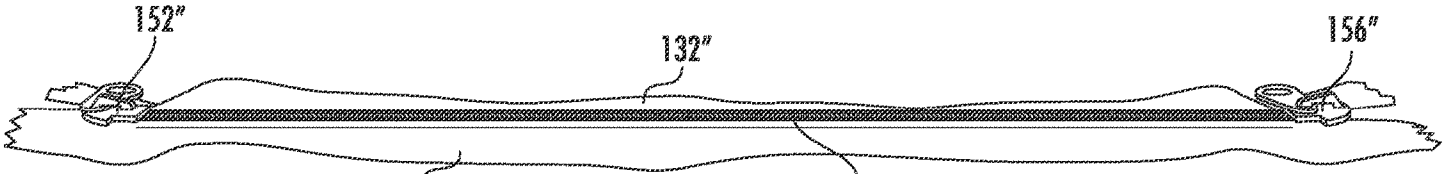
FIG. 7B shows a side perspective view of the zipper arrangement of FIG. 7A, with the zipper arrangement closed.

With reference first to FIGS. 7A and 7B, the zipper arrangement 108", including a first toothed portion 132" and a second toothed portion 136", is shown with the zipper arrangement 108" closed. In this embodiment, the stop 160" is barely visible from the front and the side of the zipper arrangement 108". The subtlety of the stop 160" is aesthetically pleasing as well as providing a flat arrangement with a negligible amount of added bulk.

Figure 8:
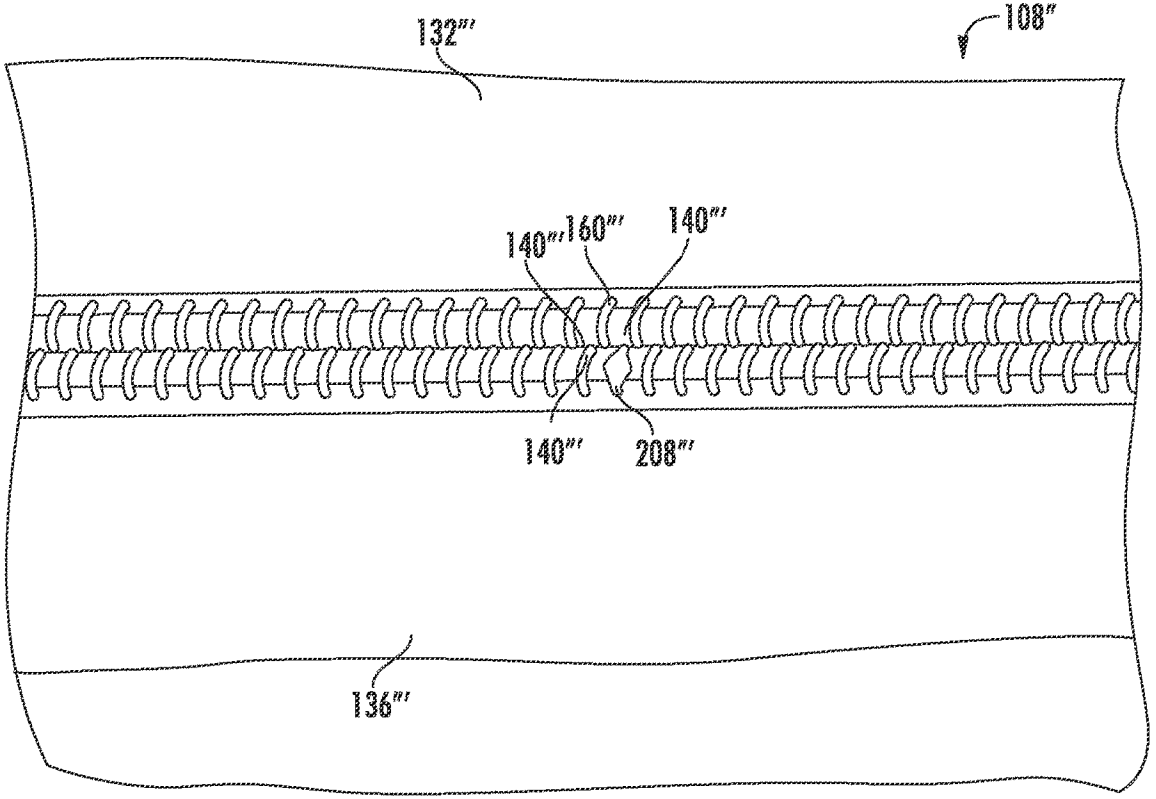
FIG. 8 shows a close-up view of a portion of a back side of the zipper arrangement of FIG. 7A, with the zipper arrangement closed.

As shown in FIG. 8, the stop 160" is more clearly visible from a back view of the zipper arrangement 108". The stop 160" is formed by altering at least one of the interlocking teeth 140" on at least one of the first toothed portion 132" and the second toothed portion 136" such that the first toothed portion 132" is permanently engaged with the second toothed portion 136" at the stop 160", and the first and second sliders 152", 156" (shown in FIGS. 7A and 7B) cannot slide past the stop 160". In particular, in this embodiment, the stop 160" is formed by altering just one of the interlocking teeth 208" on the second toothed portion 136". The altered interlocking tooth 208" can be, for example, melted, or otherwise fused, to an adjacent interlocking tooth 140" of the first toothed portion 132", bent, or otherwise deformed, so as to interfere with an adjacent interlocking tooth 140" of the first toothed portion 132", or moved or deformed to accommodate a pin (not shown) or other element inserted between the altered interlocking tooth 208" and an adjacent interlocking tooth 140" to prevent the first and second sliders 152", 156" from sliding past the stop 160".

In embodiments where the zipper arrangement 108" is waterproof, the trim or flashing 144", 148" of the zipper arrangement 108" can be made of a polymer material. Accordingly, in such embodiments, it is also possible to form the stop 160" by melting, or otherwise fusing, the altered interlocking tooth 208" to the first or second flashing 144", 148", which is configured to cover the interlocking teeth 140" on the front side of the zipper arrangement 108". In other words, in at least one embodiment, the stop 160" can be formed by melting, or otherwise fusing, the altered interlocking tooth 208" to the first or second flashing 144", 148" on the front side of the zipper arrangement 108".

Figure 9:
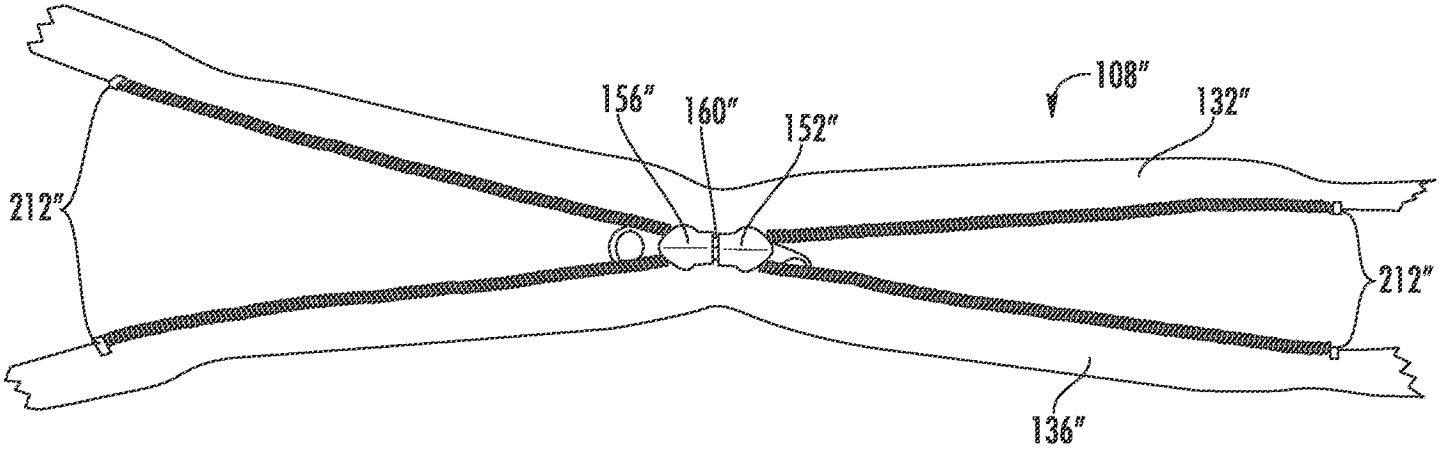
FIG. 9 shows the back side of the zipper arrangement of FIG. 7A, with the zipper arrangement open.

As shown in FIG. 9, the first and second sliders 152", 156" are both moved to an inner position wherein they are prevented from sliding past the stop 160". As noted previously, the sliders are prevented from moving past the stop 160 because the teeth 140 at the stop 160 are not releasable and are permanently attached at the stop. Additionally, in at least one embodiment, the zipper arrangement 108" also includes end stops 212", which are more clearly visible when the zipper arrangement 108" is not attached to a fabric portion and when the zipper arrangement 108" is open. The end stops 212" prevent the first and second sliders 152", 156" from sliding off ends of the first and second toothed portions 132", 136" opposite the stop 160". In other words, the sliding movement of the first and second sliders 152", 156" is limited by the stop 160" and by the end stops 212".

Figure 11:
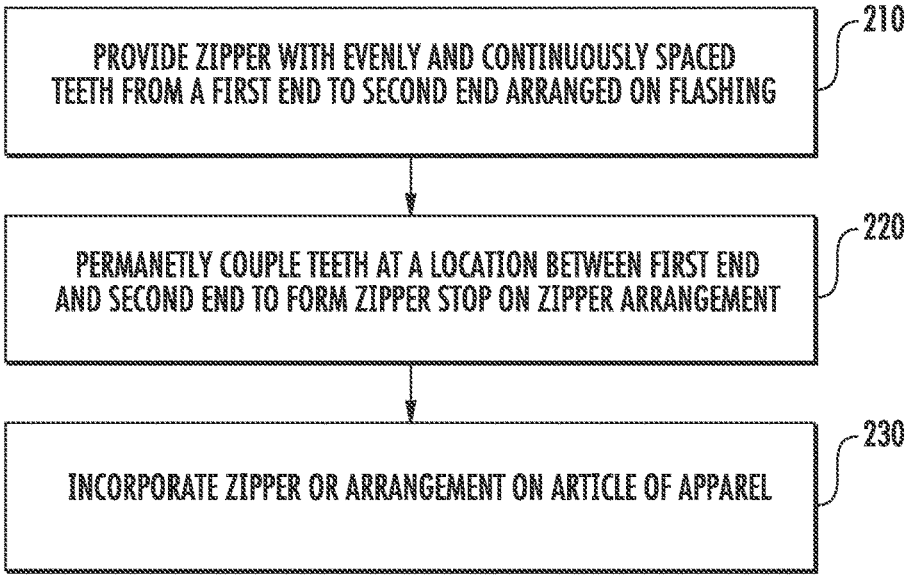
FIG. 11 is a logical flow diagram of a method of making an article of apparel using the zipper arrangement of FIG. 10B.

With reference now to FIG. 11, the zipper arrangement 108 described herein provides for a method of making an article of apparel that includes the zipper arrangement. The method begins with step 210, wherein a zipper arrangement is provided with teeth arranged on a flashing. As noted previously, the teeth are evenly and continuously spaced teeth from a first end to a second end of the zipper arrangement. Next, in step 220, the method continues when at least two teeth between the first end and the second end of the zipper arrangement are fused, adhered, or otherwise permanently coupled together to form a central stop in the zipper arrangement. FIG. 10B shows an example of such a zipper arrangement 108 including teeth 140 evenly and continuously spaced between the first end 125 and the second end 129 of the zipper arrangement 108. Although a break 199 is shown in the zipper arrangement in FIG. 10B, this is merely for the sake of convenience to allow the teeth 140 to be shown in an enlarged manner in the figure. Accordingly, it will be recognized that the spacing and density of the teeth continues on the zipper arrangement through the break 199. Additionally, a second slider is not shown in FIG. 10B, but is positioned within the space represented by the break 199. In the embodiment of FIG. 10B, teeth 140*a* and 140*b* on the first toothed portion 132 are fused or otherwise permanently attached to the tooth 140*c* on the second toothed portion 136. It will be recognized that any of various teeth between the first end and the second end of the zipper arrangement may be selected as the teeth that will provide the central stop. Typically, the teeth chosen to provide the central stop will be at a location on the zipper arrangement such that the stop is positioned at the pocket separation 192 (e.g., see FIG. 3A) on a garment or other article of apparel on which the zipper arrangement will be mounted.

Figure 12:
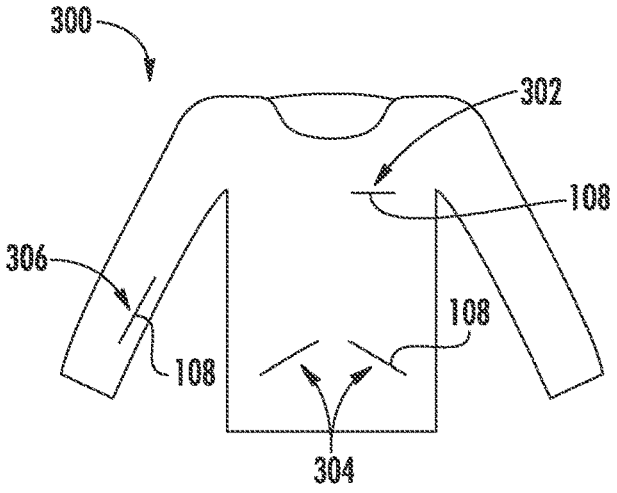
FIG. 12 shows a front view of a shirt with the zipper arrangement of FIG. 1A incorporated into the shirt at several exemplary locations.

With reference again to FIG. 11, after the selected teeth of the zipper arrangement are permanently coupled together, the zipper arrangement is incorporated into a garment or other article of apparel. As noted above, the zipper arrangement may be positioned on the article of apparel such that the central stop separates a first pocket from a second pocket in the article of apparel. FIG. 12 illustrates the zipper arrangement positioned at several locations on a shirt 300, including a chest pocket location 302, two abdominal locations 304, and a sleeve location 306. However, it will be recognized that the zipper arrangement 108 may be placed at any desired location on the shirt 300 or other article of apparel. Moreover, although FIG. 11 indicates that the stop is formed prior to incorporation of the zipper arrangement into the article of apparel, it will be appreciated that the stop may also be formed after the zipper arrangement is incorporated into the article of apparel.

The foregoing example embodiments are but a few of numerous possible embodiments for the zipper arrangement, and it will be recognized that numerous additional embodiments are also possible and the foregoing embodiments should not be considered as limiting in any way. It will also be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A zipper arrangement comprising:

a first toothed portion including a plurality of teeth provided along a first edge extending from a first end to a second end;

a second toothed portion including a plurality of teeth provided along a second edge extending between a first end and a second end;

and a stop positioned between the first end and the second end, the stop provided by at least a first tooth of the first toothed portion non-releasably coupled to a second tooth of the second toothed portion.

2. The zipper arrangement of claim 1 further comprising a first slider positioned on a first side of the stop and a second slider positioned on a second side of the stop, wherein movement of the first slider in a first direction releasably couples the first toothed portion to the second toothed portion on the first side of the stop, and movement of the first slider in a second direction opposite the first direction decouples the first toothed portion from the second toothed portion on the first side of the stop.

3. The zipper arrangement of claim 2 wherein the stop blocks the first slider from moving to the second side of the stop.

4. The zipper arrangement of claim 1 wherein the first tooth is fused to the second tooth.

5. The zipper arrangement of claim 1 wherein the first tooth is adhered to the second tooth.

6. The zipper arrangement of claim 1 wherein the first tooth is sewn to the second tooth.

7. The zipper arrangement of claim 1 wherein the plurality of teeth are evenly and continuously spaced along the first toothed portion and the second toothed portion.

8. The zipper arrangement of claim 1 wherein the zipper arrangement is provided on a garment with a first pocket and a second pocket, wherein the stop separates the first pocket from the second pocket.

9. An article of apparel comprising:

at least one fabric portion including at least one opening; and a zipper arrangement including:

a first toothed portion fixedly coupled to the at least one fabric portion along the at least one opening;

a second toothed portion fixedly coupled to the at least one fabric portion along the at least one opening;

at least two sliders, each slider slidably positioned on each of the first toothed portion and the second toothed portion so as to selectively couple teeth of the first toothed portion to teeth of the second toothed portion and decouple teeth of the first toothed portion from teeth of the second toothed portion; and at least one stop formed by a non-releasable coupling of a first tooth of the first toothed portion and a second tooth of the second toothed portion such that the first tooth and the second tooth are permanently coupled to one another and the first toothed portion is non-releasably coupled to the second toothed portion at the at least one stop.

10. The article of apparel of claim 9, wherein:

the at least one opening includes a first opening edge and a second opening edge, the first toothed portion is fixedly coupled to the at least one fabric portion along the first opening edge, and the second toothed portion is fixedly coupled to the at least one fabric portion along the second opening edge.

11. The article of apparel of claim 9, wherein:

the at least one opening forms a first sub-opening on a first side of the at least one stop and a second sub-opening on a second side of the at least one stop.

12. The article of apparel of claim 11, further comprising:

a first pocket accessible through the first sub-opening, and a second pocket accessible through the second sub-opening.

13. The article of apparel of claim 11, wherein the at least two sliders include a first slider slidably retained on the first and second toothed portions at the first sub-opening and a second slider slidably retained on the first and second toothed portions at the second sub-opening.

14. A zipper arrangement, comprising:

a first toothed portion including a plurality of first teeth;

a second toothed portion including a plurality of second teeth;

a stop formed by at least one of the plurality of first teeth non-releasably engaged with at least one of the plurality of second teeth at the stop such that the at least one of the plurality of first teeth are irremovable from the at least one of the plurality of second teeth without destruction thereof;

a first slider slidably received on the first toothed portion and the second toothed portion on a first side of the at least one stop to selectively engage the first toothed portion with the second toothed portion and disengage the first toothed portion from the second toothed portion on the first side of the stop; and a second slider slidably received on the first toothed portion and the second toothed portion on a second side of the stop to selectively engage the first toothed portion with the second toothed portion and disengage the first toothed portion from the second toothed portion on the second side of the stop.

15. The zipper arrangement of claim 14 wherein at least one of the plurality of first teeth is fused or permanently adhered to at least one of the plurality of second teeth.

16. The zipper arrangement of claim 14 wherein the plurality of first teeth and the plurality of second teeth are evenly and continuously spaced between a first end and a second end of the zipper arrangement.

17. A method of making an article of apparel, the method comprising:

providing a zipper arrangement including a first edge and a second edge extending from a first end to a second end of the article of apparel, providing a first toothed portion along the first edge of the zipper arrangement and a second toothed portion extending along the second edge of the zipper arrangement, the first toothed portion including a plurality of first teeth, the second toothed portion including a plurality of second teeth; and forming a stop in the zipper arrangement by non-releasably coupling at least one of the plurality of first teeth to at least one of the plurality of second teeth such that the at least one of the plurality of first teeth are irremovable from the at least one of the plurality of second teeth without destruction thereof.

18. The method of claim 17 wherein the plurality of first teeth and the plurality of second teeth are evenly and continuously spaced between a first end and a second end of the zipper arrangement, and wherein the stop is formed at a position between the first end and the second end.

19. The method of claim 17 wherein the stop is formed by fusing or permanently adhering the at least one of the plurality of first teeth to the at least one of the plurality of second teeth.

20. The method of claim 17 further comprising, incorporating the zipper arrangement into the article of apparel with the stop positioned between a first pocket and a second pocket.

21. The method of claim 17 wherein the stop is formed by deforming the at least one of the plurality of first teeth and/the at least one of the plurality of second teeth such that the at least one of the plurality of first teeth is non-releasably coupled to the at least one of the plurality of second teeth.

* * * * *